US005614998A

United States Patent [19]

Sanpe

[11] Patent Number: 5,614,998

[45] Date of Patent: Mar. 25, 1997

[54] IMAGE FORMING APPARATUS HAVING A TONER RECYCLING MECHANISM

[75] Inventor: Atsushi Sanpe, Yokohama, Japan

[73] Assignee: Ricoh Company, Ltd., Tokyo, Japan

[21] Appl. No.: 561,852

[22] Filed: Nov. 22, 1995

[30] Foreign Application Priority Data

Dec. 12, 1994 [JP] Japan ..... 6-307493

[51] Int. Cl.[6] ..... G03G 15/16

[52] U.S. Cl. ..... 399/314; 399/296

[58] Field of Search ..... 355/271, 273, 355/274, 275, 308

[56] References Cited

U.S. PATENT DOCUMENTS

| | | | |
|---|---|---|---|
| 5,132,738 | 7/1992 | Nakamura et al. | 355/274 |
| 5,386,274 | 1/1995 | Sanpe et al. | 355/274 X |
| 5,455,664 | 10/1995 | Ito et al. | 355/273 X |

FOREIGN PATENT DOCUMENTS

| | | |
|---|---|---|
| 63-286878 | 11/1988 | Japan . |
| 2-121765 U | 10/1990 | Japan . |
| 3-126062 | 5/1991 | Japan . |
| 5-181372 | 7/1993 | Japan . |
| 6-266250 | 9/1994 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

In an image forming apparatus, an exposing device electrostatically forms a latent image on an image carrier while a developing device develops the latent image with toner to thereby form a corresponding toner image. An image transferring device transfers the toner image to a sheet in contact with the image carrier. A pretransfer lamp discharges the image carrier before the transfer of the toner image to the sheet. A bias applying device applies a bias voltage at the time of the image transfer. A cleaning device removes the toner remaining on the image carrier after the image transfer. A toner conveying device conveys the toner removed by the cleaning device to the developing device. The bias applying device applies the bias voltage only when the sheet exists between the image carrier and the transferring device. The apparatus prevents toner particles charged to the polarity opposite to the expected polarity during an interval between consecutive sheets from being returned to the developing device via the cleaning device, and in addition allows such toner particles to be effectively reused.

32 Claims, 6 Drawing Sheets

IMAGE FORMING APPARATUS HAVING A TONER RECYCLING MECHANISM

BACKGROUND OF THE INVENTION

The present invention relates to a copier, printer, facsimile apparatus or similar electrophotographic image forming apparatus and, more particularly, to an image forming apparatus having a toner recycling mechanism.

It has been customary with an image forming apparatus of the type described to remove toner left on a photoconductive element or image carrier after image transfer, temporarily store it in a cleaning device or similar toner collecting means, and then discard it. However, a current trend in the imaging art is toward the recycling of the used or waste toner for the protection of environment and ecology. To recycle the toner, a transfer belt may be used to remove paper dust and other impurities from the toner before the toner is brought to the cleaning device, as proposed in the past.

In a repeat copy mode, it is a common practice to maintain both a bias voltage for image transfer and a pretransfer lamp (PTL) in an ON state not only during the image transfer but also during the interval between consecutive sheets. Particularly, a bias voltage for image transfer is continuously applied even during the interval between consecutive sheets, i.e., when image transfer is not effected. As a result, toner particles deposited on the drum at the interval between sheets and charged to the polarity opposite to the expected polarity, e.g., negative polarity are directly conveyed to a cleaning device which cleans the drum. Consequently, the toner of opposite polarity is conveyed to a toner hopper via the cleaning device together with the usual toner remaining after image transfer. This part of the toner is apt to cohere in the hopper and to have its polarity disturbed in the hopper due to aging, resulting in defective images. In this respect, Japanese Utility Model Laid-Open Publication No. 2-121765 teaches an implementation for reducing the quantity of light to issue from a discharge lamp in the event of image transfer.

The transfer belt in movement carries thereon the toner scattered around without being transferred to the sheet, the toner directly deposited on the belt, and paper dust which comes from the sheet. Preferably, the toner and paper dust, i.e., impurities should be prevented from being returned to the developing device. Some different approaches have been proposed to remove the impurities from the belt by cleaning the belt, and then discarding them while returning the other toner or collected toner to the developing device. Japanese Utility Model Laid-Open Publication Nos. 58-29480, 58-79767, 58-29480, 60-41580, 56-14277 and 58-189674, for example, each discloses a toner recycling system which separates toner particles of opposite polarity by use of an electric field. However, all these schemes need exclusive bias applying means and result in a bulky and complicated apparatus.

There has also been proposed a color copier in which an electric field for image transfer is applied only when a sheet exists between a photoconductive drum and a transfer belt. However, this scheme is not directed toward the collection and reuse of toner left after image transfer.

SUMMARY OF THE INVENTION

It is therefore an object of the present invention to provide a cost-effective and simple image forming apparatus capable of preventing toner particles charged opposite polarity at the interval between consecutive sheets from being returned to a developing device, and in addition capable of using even such toner effectively.

An image forming apparatus of the present invention has an exposing device for electrostatically forming a latent image on an image carrier. A developing device develops the latent image with toner to thereby form a corresponding toner image. A transferring device transfers the toner image to a sheet in contact with the image carrier. A pretransfer lamp discharges the image carrier before the transfer of the toner image to the sheet. A bias applying device applies a bias voltage at the time of the transfer of the toner image to the sheet. A cleaning device removes the toner remaining on the image carrier after the transfer of the toner image to the sheet. A toner conveying device conveys the toner removed by the cleaning device to the developing device. A bias control device causes the bias applying device to apply the bias voltage only when the sheet exists between the image carrier and the transferring device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
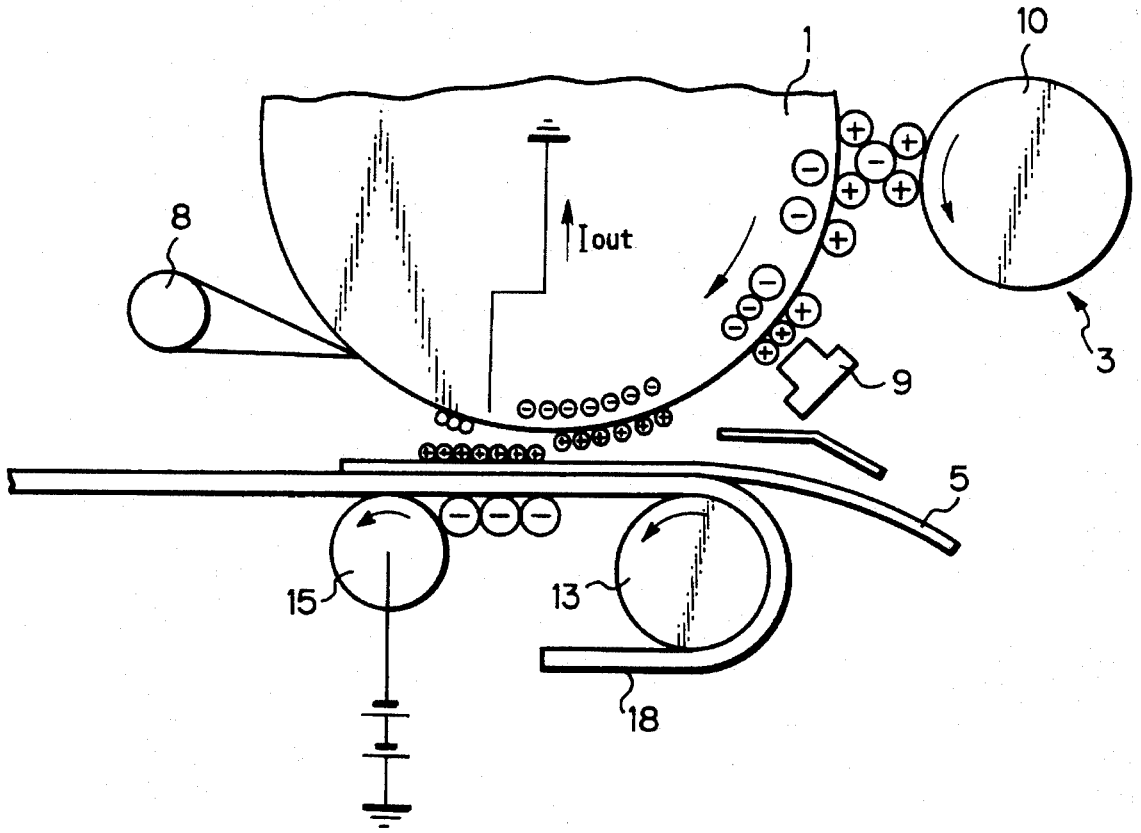
Fig. 1 PRIOR ART
FIG. 1 shows the condition of charged toner particles to occur during image transfer in a conventional image forming apparatus.

To better understand the present invention, a brief reference will be made to a conventional image forming apparatus, shown in FIG. 1. It has been customary with an image forming apparatus to maintain, in a repeat copy mode, both a bias voltage for image transfer and a pretransfer lamp (PTL) in an ON state. Specifically, as shown in FIG. 1, toner charged to the positive polarity in a developing device 3 is transferred from a developing sleeve 10 to a photoconductive drum or image carrier 1. Subsequently, a PTL 9 illuminates the drum 1 in order to lower the potential thereof, i.e., the adhesion of the toner to the drum 1. A negative charge is applied to a bias roller 15 for image transfer. As a result, the toner is transferred to a sheet 5 being conveyed by a transfer belt 18.

Figure 2:
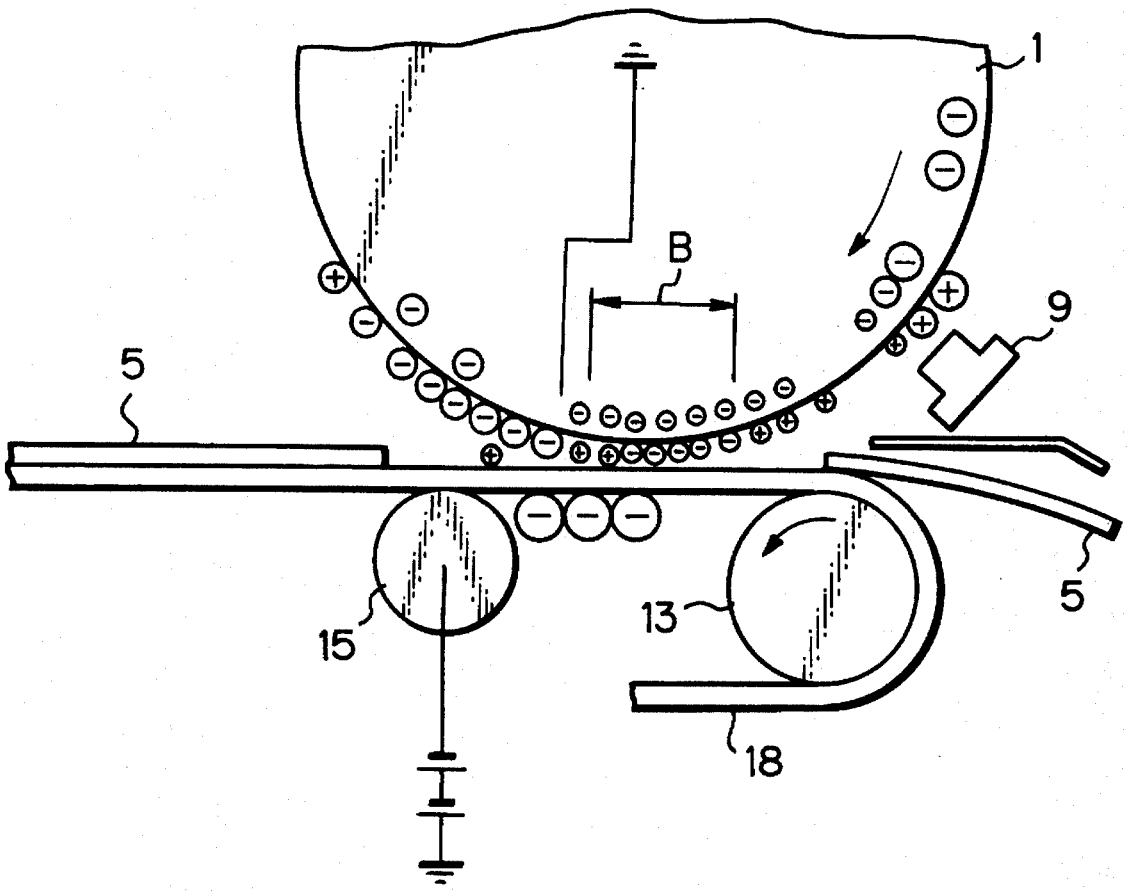
Fig. 2 PRIOR ART
FIG. 2 shows the condition of the charged toner particles to occur at the interval between consecutive sheets in the conventional apparatus.

The problem with the above configuration is that the bias voltage is applied to the bias roller 15 even during the interval between the consecutive sheets 5. Specifically, as shown in FIG. 2, the toner existing on the drum 1 between the sheets 5 has mostly been charged to the negative polarity. When such toner arrives at a nip B between the belt 18 and the drum 1, it is subjected to an intense electric field (−3 kV to −7 kV) without the intermediary of the sheet 5 due to its own negative charge and the negative charge of the bias roller 15. As a result, charge is injected into the toner charged to the negative or opposite polarity and thereby causes the toner to be strongly attracted by the drum 1 which is higher in potential than the belt 18 by about 2 kV to 6 kV. The toner of opposite polarity is directly brought to a cleaning device which cleans the drum 1. Of course, even the toner of positive or expected polarity is inverted in polarity. The toner of opposite polarity and not sufficiently separated is conveyed to a toner hopper via the cleaning device together with the regular toner left after image transfer. This part of the toner is apt to cohere in the hopper and to have its polarity disturbed in the hopper due to aging, resulting in defective images.

Figure 3:
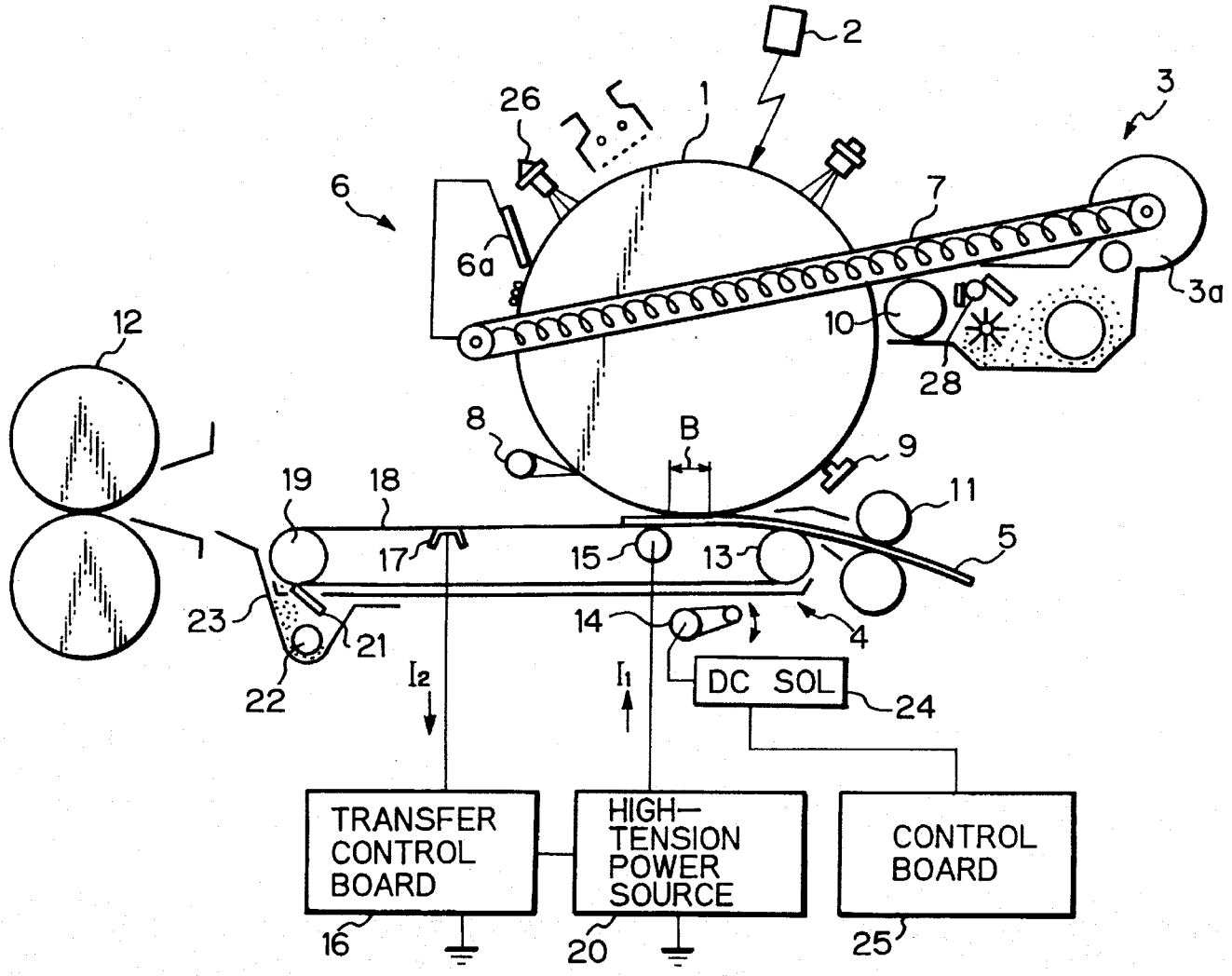
FIG. 3 shows the construction of an image forming apparatus in accordance with the present invention.

Referring to FIG. 3, the present invention free from the above problem will be described. As shown, a separator 8 for separating a sheet 5 from the drum 1, a cleaning device or cleaning means 6, exposing means 2 for electrostatically forming a latent image on the drum 1, a developing device or developing means 3 having a developing sleeve 10, a PTL 9, and a transfer belt unit or image transferring means 4 are arranged around a photoconductive drum or image carrier 1. The constituents 2–9 are each held in contact with or positioned in close proximity to the drum 1.

The cleaning device 6 and developing device 3 are connected to each other by a coil or toner conveying means 7. The transfer belt unit 4 includes a transfer belt 18 passed over a drive roller 13 and a driven roller 19. A bias roller for image transfer, or bias applying means, 15 and a ground plate 17 are held in contact with the inner periphery of the belt 18. A high-tension power source 20 and a transfer control board or bias control means 16 are connected to the bias roller 15 and ground plate 17, respectively. The power source 20 and transfer control board 16 are electrically connected to each other, and so are the control board 16 and PTL 9.

A lever 14 is connected to a DC solenoid 24 which is operated by a signal fed from a control board 25. The lever 14 selectively urges the belt 18 against the drum 1. A cleaning blade 21 is abutted against the driven roller 19 via the belt 18 in order to clean the belt 18. A toner receiver 23 is disposed below the blade 21 and accommodates a coil 22 for collecting toner. The belt 18, drive roller 13, driven roller 19, bias roller 15, and blade 21 constitute the transfer belt unit 4. A registration roller pair 11 and a fixing device 12 are respectively located on a sheet transport path upstream and downstream of the belt 18.

In operation, a document is illuminated by a halogen lamp, although not shown in the figure. The resulting reflection from the document is focused onto the drum 1 by the exposing means 2. Negative charge uniformly deposited on the drum 1 is selectively dissipated in accordance with the intensity distribution of the incident light, so that a latent image or potential distribution is formed on the drum 1. The developing device 3 deposits toner to the latent image on the drum 1 to thereby form a corresponding toner image. Specifically, a negative bias voltage lower than the charge potential of the drum 1 is applied to the developing sleeve 10. As a result, the toner charged to the positive polarity due to the agitation of carrier is transferred from the sleeve 10 to the drum 1, thereby developing the latent image. Subsequently, the PTL 9 illuminates the entire surface of the drum 1 in order to lower the surface potential thereof. This successfully increases the efficiency of image transfer to follow.

A sheet 5 once stopped by the registration roller pair 11 is again driven by the roller pair 11 such that its leading edge meets the leading edge of the toner image carried on the drum 1. As soon as the leading edge of the sheet 5 approaches the position where the drum 1 and belt 18 adjoin each other, the lever 14 urges the belt 18 against the drum 1. As a result, a nip B having a width of 4 mm to 8 mm is formed between the drum 1 and the belt 18. On the entry of the sheet 5 into the nip B, a bias voltage is applied to the bias roller 15 with the result that a charge opposite in polarity to the toner on the drum 1 is deposited on the belt 18. Consequently, the toner image is transferred from the drum 1 to the sheet 5.

In accordance with the present invention, after the surface of the drum 1 has been charged to −940 V, the latent image is developed by the toner of positive polarity. Then, the PTL 9 lowers the surface potential of the drum 1. Subsequently, a voltage of −3 kV to −7 kV is applied to the bias roller 15 so as to transfer the developed image or toner image to the sheet 5. At this instant, the potential of the belt 18, at measured as the nip B, ranges from −2 kV to −6 kV. As shown in FIG. 3, assume that the output current of the high-tension power source 20 is $I_1$, and that the current to flow from the ground plate 17 to the ground via the belt 18 is $I_2$. Then, the current $I_1$ is controlled such that $I_1-I_2=I_{out}$ (constant) holds.

On the application of the bias voltage to the bias roller 15, the sheet 5 is charged with the result that the toner image is transferred from the drum 1 to the sheet 5. At the same time, the sheet 5 is caused to adhere to the belt 18 away from the drum 1 due to an electrostatic force derived from the true charge of the belt 18 and the polarization charge of the sheet 5. As the sheet 5 is conveyed by the belt 18 past the ground plate 17, it is sequentially discharged by the ground plate 17 via the belt 18. On reaching the position where the drive roller 19 is located, the sheet 5 is separated from the belt 18 due to the lowered electrostatic adhesion.

After the above procedure, the belt 18 is brought out of contact with the drum 1 by the lever 14; should the drum 1 be held in contact with the belt 18 for a long period of time, it would be contaminated. The cleaning blade 21 held in contact with the driven roller 19 removes from the belt 18 the toner scattered around without being transferred to the sheet 5, toner directly deposited on the belt 18, and paper dust which comes from the sheet 5. In this respect, the surface of the belt 18 should have a coefficient of friction μ sufficiently smaller than the coefficient of friction of the blade 21; otherwise, the belt 18 would increase the drive torque necessary for the transfer belt unit 4 and would turn over the blade 21.

In accordance with the present invention, the belt 18 has its surface coated with fluorine (polyvinyliden fluoride), and can therefore be cleaned in a desirable manner. The toner and paper dust dropped into the toner receiver 23 is conveyed by the coil 22 from the transfer belt unit 4 to a waste toner bottle, not shown, mounted on a copier body.

On the other hand, the toner left on the drum 1 after the image transfer is scraped off by a cleaning blade **6*a* included in the cleaning device 6. This part of the toner is returned by the coil 7 to a toner hopper 3*a* forming a part of the developing device 3. Alternatively, the above part of the toner may be directly returned to a screw 28 which conveys the carrier for development. A discharge lamp 26 illuminates the entire surface of the drum 1 whose surface has been cleaned by the cleaning blade 6*a*, thereby dissipating the charge remaining on the drum 1. This prepares the drum 1** for the next copying operation.

In a repeat copy mode, the surface potential of the drum 1 and the bias for development are respectively −70 V to −80

V and −200 V as measured during the interval between consecutive sheets 5. As a result, the part of the toner charged to the opposite polarity, i.e., negative polarity and existing in the developing device 3 is deposited on the drum 1 for the following reason. Usually, toner particles are charged by being rubbed by carrier particles. However, toner particles rub each other when, for example, the carrier particles are spent (when pulverized toner resin adheres to the carrier particles) or when the toner concentration is excessively high. In this condition, one toner particle is charged to the expected polarity, but the other is charged to the opposite polarity. Such toner particles attract each other due to the Coulomb's force, and therefore remain in the positive or negative polarity together. Consequently, even the toner particles of positive polarity are transferred to the drum 1 together with the toner particles of opposite polarity.

Figure 4:
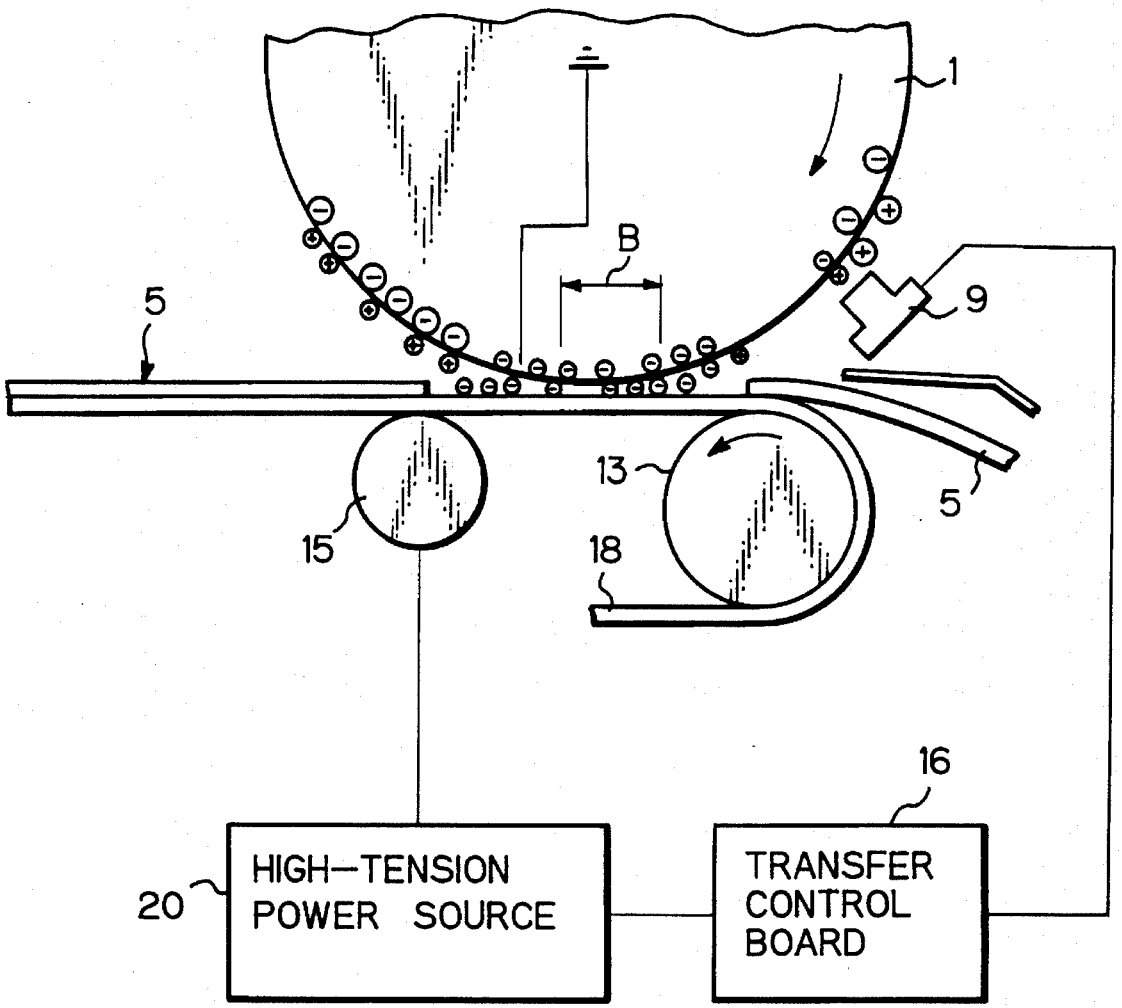
FIG. 4 shows the condition of charged toner particles to occur at the interval between sheets in the apparatus of FIG. 3.
Figure 5:
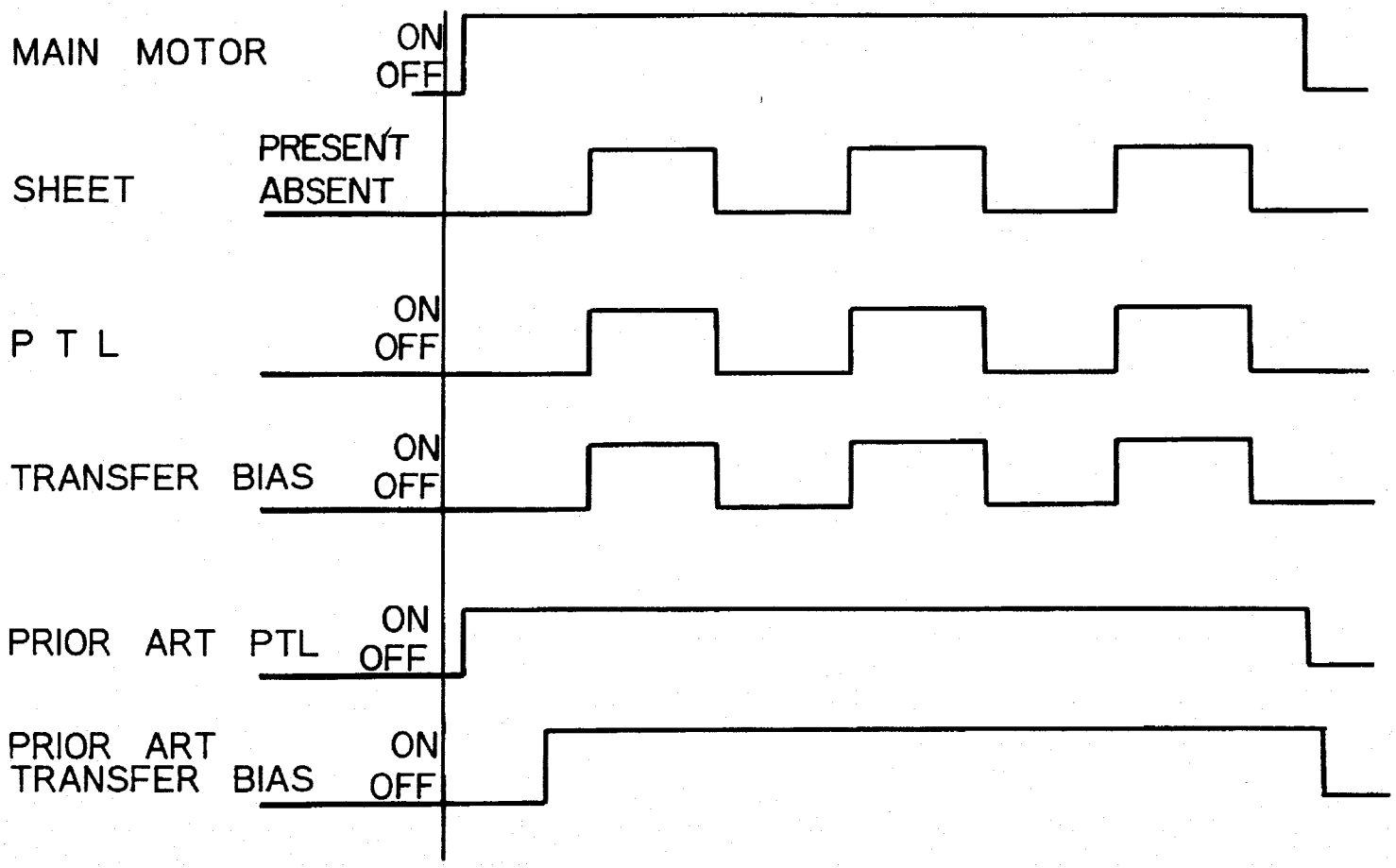
FIG. 5 is a timing chart representative of the operation of a pretransfer lamp (PTL) and bias applying means.

A preferred embodiment of the present invention will be described hereinafter. As shown in FIG. 4, assume that image transfer is not effected at the nip B due to the interval between consecutive sheets 5. Then, as also shown in FIG. 5 (Transfer Bias), the transfer control board 16 turns off the bias voltage for the belt 18 in respect of timing; that is, it turns on the bias voltage only during the image transfer, i.e., when the sheet 5 is present at the nip B. In this condition, the toner of opposite polarity is electrostatically transferred from the drum 1 to the belt 18 due to a difference in potential (30 V to 40 V) between the drum 1 discharged by the PTL 9 and the belt 18. This part of the toner is therefore not conveyed to the cleaning device 6 or recycled.

An alternative embodiment of the present invention is as follows. Originally, in a hot and humid atmosphere, the PTL 9 optically discharges the drum 1 in order to reduce the adhesion acting between the drum 1 and the toner deposited thereon and thereby promotes easy image transfer. However, when the potential the drum 1 approaches zero due to the illumination of the PTL 9, the difference in potential between the drum 1 and the belt 18 increases and allows a current to flow easily. As a result, it is likely that a charge is injected into the toner. Because an electric field formed in this condition is inversely proportional to the square of the distance, it is far more intense at the position where the sheet 5 is absent than at the position where the sheet 5 is present.

As shown in FIG. 5 (Prior Art PTL), it has been customary to turn on a PTL in synchronism with a main motor in a repeat copy mode. As a result, during the interval between the sheets 5, even the previously stated $I_{out}$=constant control scheme (differential constant current system) fails to prevent the electric field from becoming excessive during the interval between the sheets 5. Hence, the toner between the drum 1 and the belt 18 is subjected to the intense electric field and inverted in polarity due to charge injection.

As shown in FIG. 5 (PTL), the transfer control board 16 turns off the PTL 9 during the interval between the sheets 5 in a repeat copy mode, while turning it on during the image transfer. With this configuration, it is possible to reduce the electric field during the interval between the sheets 5, and therefore the charge injection into the toner. This successfully reduces the ratio of the toner of opposite polarity to the entire collected toner and renders the collected toner suitable for reuse.

In this embodiment, the potential of the drum 1 at the interval between the sheets 5 is −70 V to −80 V and is directly applied to the belt 18 because the PTL 9 is turned off. When the PTL 9 is turned off at the same time as the bias voltage (previous embodiment) during the interval between the sheets 5, the potential of the drum 1 increases at the above interval. Consequently, the adhesion acting between the toner and the belt 18 is greater than in the previous embodiment and thereby separates the toner of opposite polarity more effectively.

However, it is likely that the cleaning ability available with the embodiments is not sufficient to remove the toner adhering to the surface of the belt 18 with the intensity stated above. Another alternative embodiment capable of obviating this problem will be described with reference to FIG. 6.

Figure 6:
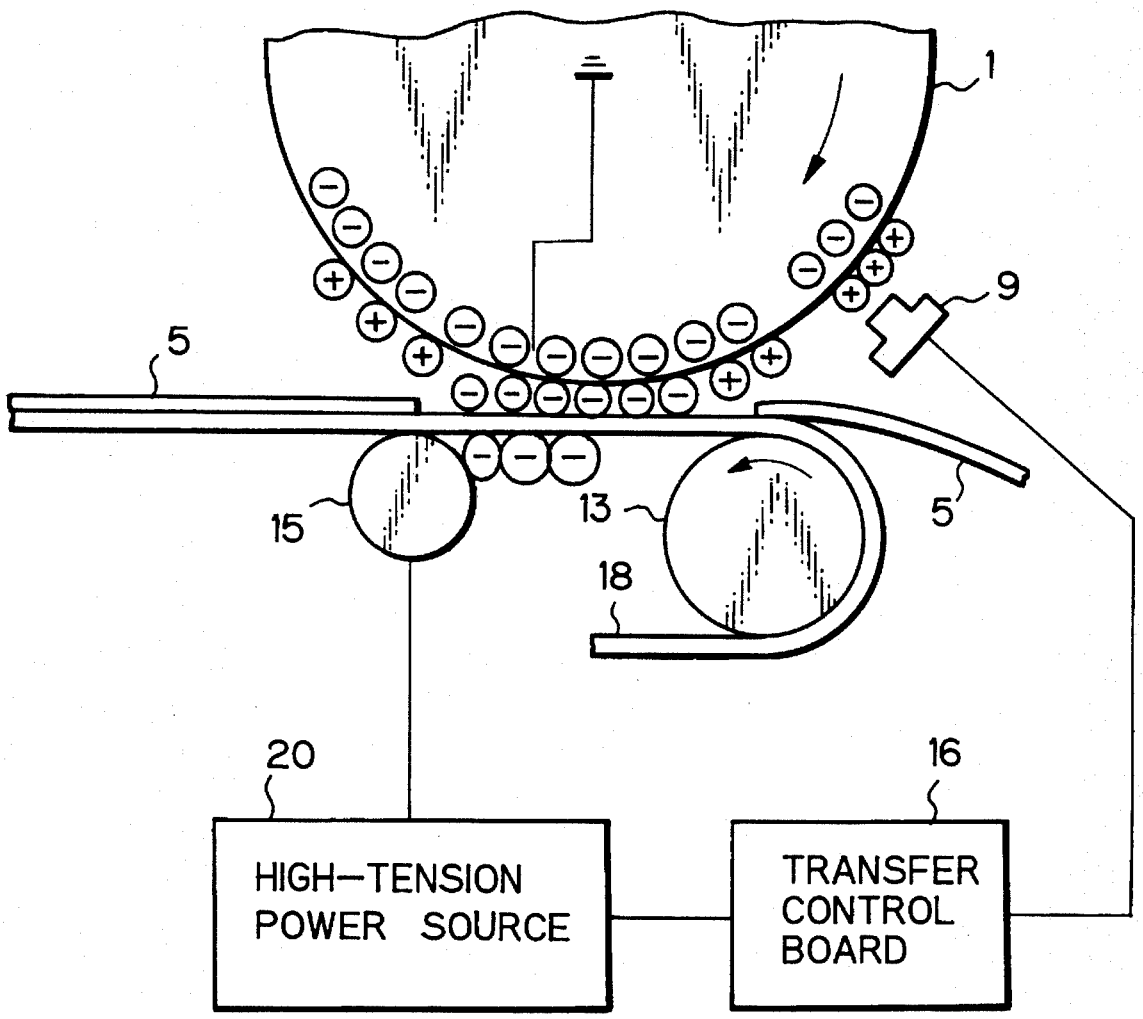
FIG. 6 shows the condition of charged toner particles to occur in an alternative embodiment of the present invention.

As shown in FIG. 6, the bias voltage applied to the belt 18 is selected to be lower during the interval between the sheets 3 than during the image transfer, and to be substantially equal to or slightly higher than the potential of the drum 1. This is determined on the basis of the previously stated differential current $I_{out}$. Such a slight difference in potential between the drum 1 and the belt 18 allows the toner of opposite polarity to adhere to the belt 18 with only a relatively weak electrostatic force at the interval between the sheets 5. The toner can therefore be removed from the belt 18 and collected more easily than in the previous embodiments.

Specifically, during the interval between the sheets 5, the potential of the drum 1 is selected to be −30 V to −40 V when the PTL 9 is turned off. The differential current $I_{out}$ is controlled such that the bias voltage for image transfer is 5 V to 20 V higher than the potential of the drum 1. The toner of opposite polarity is deposited on the belt 18 and then removed therefrom by the cleaning blade 21.

Of course, it the expected charging characteristic of the toner is opposite to the above characteristic, the relation between the drum 1 and the belt 18 with respect to potential will be reversed. While the contact type image transferring means is implemented by the belt 18, the belt 18 may be replaced with, e.g., a roller of inductive sponge rubber comparable in electric resistance with the belt 18. In such a case, use must be made of, e.g., a metallic cleaning blade or a fur brush in place of the rubber blade of the embodiment.

In summary, it will be seen that the present invention provides an image forming apparatus having various unprecedented advantages, as enumerated below.

(1) Toner of opposite polarity can be transferred to transferring means at the interval between consecutive sheets and effectively collected by the transferring means.

(2) The toner of opposite polarity can be separated without resorting to an exclusive device for separation. Even when such toner is reused, stable images are achievable over a long period of time. This is space-saving and cost-effective.

(3) The toner adheres to a transfer belt with an intense electrostatic force, and can therefore be effectively separated.

(4) An image carrier suffers from a minimum of fatigue due to bias voltages for image transfer and PTL illumination, and therefore achieves a long service life.

(5) The adhesion of the toner of opposite polarity to the transferring means is lowered, so that the transferring means can be efficiently cleaned over a long period of time. This protects the rear of sheets from contamination.

Various modifications will become possible for those skilled in the art after receiving the teachings of the present disclosure without departing from the scope thereof.

What is claimed is:

1. An image forming apparatus comprising:

exposing means for electrostatically forming a latent image on an image carrier;

developing means for developing the latent image with toner to thereby form a corresponding toner image;

transferring means for transferring the toner image to a sheet in contact with said image carrier;

bias applying means for applying a bias voltage at the time of the transfer of the toner image to the sheet;

cleaning means for removing the toner remaining on said image carrier after the transfer of the toner image to the sheet;

toner conveying means for conveying the toner removed by said cleaning means to said developing means; and bias control means for causing said bias applying means to apply the bias voltage only when the sheet exists between said image carrier and said transferring means, when the image forming apparatus is in a repeat copy mode.

2. An apparatus as claimed in claim 1, further comprising:

a pretransfer lamp for discharging said image carrier before a transfer of the toner image to the sheet, wherein said bias control means causes said pretransfer lamp to illuminate an area of said image carrier which the sheet is to contact.

3. An apparatus as claimed in claim 1, wherein said bias control means causes, during an interval between consecutive sheets and during which the transfer of the toner image is not effected, said bias applying means to output a bias voltage equal to or slightly different from a charge potential deposited on said image carrier, and having a same polarity as the toner of regular polarity.

4. An apparatus as claimed in claim 1, wherein said transferring means comprises an endless belt.

5. An apparatus as claimed in claim 1, wherein said transferring means comprises a roller.

6. An image forming apparatus comprising:

exposing means for electrostatically forming a latent image on an image carrier;

developing means for developing the latent image with toner to thereby form a corresponding toner image;

transferring means for transferring the toner image to a sheet in contact with said image carrier;

a pretransfer lamp for discharging said image carrier before a transfer of the toner image to the sheet;

bias applying means for applying a bias voltage at the time of the transfer of the toner image to the sheet;

cleaning means for removing the toner remaining on said image carrier after the transfer of the toner image to the sheet;

toner conveying means for conveying the toner removed by said cleaning means to said developing means; and bias control means for causing said bias applying means to apply the bias voltage only when the sheet exists between said image carrier and said transferring means, wherein said bias control means causes said pretransfer lamp to illuminate only an area of said image carrier which the sheet is to contact.

7. An apparatus as claimed in claim 6, wherein said transferring means comprises an endless belt.

8. An apparatus as claimed in claim 6, wherein said transferring means comprises a roller.

9. An image forming apparatus comprising:

exposing means for electrostatically forming a latent image on an image carrier;

developing means for developing the latent image with toner to thereby form a corresponding toner image;

transferring means for transferring the toner image to a sheet in contact with said image carrier;

bias applying means for applying a bias voltage at the time of the transfer of the toner image to the sheet;

cleaning means for removing the toner remaining on said image carrier after the transfer of the toner image to the sheet;

toner conveying means for conveying the toner removed by said cleaning means to said developing means; and bias control means for causing said bias applying means to apply the bias voltage only when the sheet exists between said image carrier and said transferring means, wherein said bias control means causes, during an interval between consecutive sheets and during which the transfer of the toner image is not effected, said bias applying means to output a bias voltage equal to or slightly different from a charge potential deposited on said image carrier, and having a same polarity as the toner of regular polarity.

10. An apparatus as claimed in claim 9, wherein said transferring means comprises an endless belt.

11. An apparatus as claimed in claim 9 wherein said transferring means comprises a roller.

12. An image forming apparatus, comprising:

writing means for electrostatically forming a latent image on an image carrier;

developing means for developing the latent image with toner to thereby form a corresponding toner image;

transferring means for transferring the toner image to a sheet in contact with said image carrier;

bias applying means for applying a bias voltage to said transferring means;

first cleaning means for removing the toner remaining on said image carrier after the transfer of the toner image to the sheet;

toner conveying means for conveying the toner removed by said first cleaning means to said developing means; and control means for switching, when the image forming apparatus is in a repeat copy mode for repeating an image forming cycle a plurality of number of times, the bias voltage, depending on whether the sheet exists between said image carrier and said transferring means;

wherein said control means causes, when the sheet exists between said image carrier and said transferring means, said bias applying means to apply the bias voltage to said transferring means or prevents, at an interval between consecutive sheets during which there is no sheet between said image carrier and said transferring means, said bias applying means from applying the bias voltage to thereby cause said transferring means to electrostatically collect toner of opposite polarity transferred from said developing means to an area of said image carrier corresponding to the interval between the consecutive sheets.

13. An apparatus as claimed in claim 12, wherein said image carrier is charged, and wherein an area of said image carrier corresponding to the interval between the consecutive sheets has a lower surface potential in absolute value than an area corresponding to the sheet existing between said image carrier and said transferring means.

14. An apparatus as claimed in claim 13, wherein said transferring means comprises an endless belt.

15. An apparatus as claimed in claim 13, wherein said transferring means comprises a roller.

16. An apparatus as claimed in claim 12, wherein a voltage is applied to said developing means, and wherein the voltage applied to said developing means at the interval between the consecutive sheets is lower in absolute value than the voltage applied to said developing means when the sheet exists between said image carrier and said transferring means.

17. An apparatus as claimed in claim 16, wherein said transferring means comprises an endless belt.

18. An apparatus as claimed in claim 16, wherein said transferring means comprises a roller.

19. An apparatus as claimed in claim 12, further comprising a second cleaning means for removing the toner of opposite polarity deposited on said transferring means.

20. An apparatus as claimed in claim 19, wherein said transferring means comprises an endless belt.

21. An apparatus as claimed in claim 19, wherein said transferring means comprises a roller.

22. An apparatus as claimed in claim 12, wherein said transferring means comprises an endless belt.

23. An apparatus as claimed in claim 12, wherein said transferring means comprises a roller.

24. An image forming apparatus comprising:

writing means for electrostatically forming a latent image on an image carrier;

developing means for developing the latent toner to thereby form a corresponding toner image;

transferring means for transferring the toner image to a sheet in contact with said image carrier;

bias applying means for applying a bias voltage to said transferring means;

first cleaning means for removing the toner remaining on said image carrier after the transfer of the toner image to the sheet;

toner conveying means for conveying the toner removed by said first cleaning means to said developing means; and control means for switching, when the image forming apparatus is in a repeat copy mode, the bias voltage, depending on whether or not the sheet exists between said image carrier and said transferring means;

wherein said control means causes, when the sheet exists between said image carrier and said transferring means, said bias applying means to apply the bias voltage to said transferring means or causes, at an interval between consecutive sheets during which there is no sheet between said image carrier and said transferring means, said bias applying means to apply a lower bias voltage in absolute value to said transferring means than when the sheet exists between said image carrier and said transferring means, thereby causing said transferring means to electrostatically collect toner of opposite polarity transferred from said developing means to an area of said image carrier corresponding to the interval between the consecutive sheets.

25. An apparatus as claimed in claim 24, wherein said image carrier is charged, and wherein an area of said image carrier corresponding to the interval between the consecutive sheets has a lower surface potential in absolute value than an area corresponding to the sheet existing between said image carrier and said transferring means.

26. An apparatus as claimed in claim 25, wherein said transferring means comprises an endless belt.

27. An apparatus as claimed in claim 25, wherein said transferring means comprises a roller.

28. An apparatus as claimed in claim 24, further comprising a second cleaning means for removing the toner of opposite polarity deposited on said transferring means.

29. An apparatus as claimed in claim 28, wherein said transferring means comprises an endless belt.

30. An apparatus as claimed in claim 28, wherein said transferring means comprises a roller.

31. An apparatus as claimed in claim 24, wherein said transferring means comprises an endless belt.

32. An apparatus as claimed in claim 24, wherein said transferring means comprises a roller.

* * * * *